US008042978B2

(12) United States Patent
Lu et al.

(10) Patent No.: US 8,042,978 B2
(45) Date of Patent: Oct. 25, 2011

(54) LIGHT EMITTING ASSEMBLY WITH HEAT DISSIPATION STRUCTURE

(75) Inventors: Ming Lu, Huican St. Sijhih (TW); Chak Hau Charles Pang, Fanling (HK); Kai Chiu Adam Wu, Tsuen Wan (HK); Lei Shirley Shi, Kowloon (HK)

(73) Assignee: Hong Kong Applied Science and Technology Research Institute Company Limited, Shatin (HK)

( * ) Notice: Subject to any disclaimer, the term of this patent is extended or adjusted under 35 U.S.C. 154(b) by 290 days.

(21) Appl. No.: 11/806,945

(22) Filed: Jun. 5, 2007

(65) Prior Publication Data

US 2008/0165546 A1 Jul. 10, 2008

(30) Foreign Application Priority Data

Jan. 5, 2007 (HK) ..... 07100217.0

(51) Int. Cl.
*F21V 29/00* (2006.01)
*F21V 21/26* (2006.01)

(52) U.S. Cl. ..... 362/373; 362/249.03; 362/249.1

(58) Field of Classification Search ..... 362/218, 362/294, 373, 238, 239, 250, 249.01, 249.02, 362/249.03, 249.07, 249.1
See application file for complete search history.

(56) References Cited

U.S. PATENT DOCUMENTS

| | | | | |
|---|---|---|---|---|
| 5,268,828 | A * | 12/1993 | Miura | 362/249.06 |
| 5,313,375 | A * | 5/1994 | Jones | 362/218 |
| 6,268,701 | B1 | 7/2001 | Tomme | |
| 6,402,347 | B1 * | 6/2002 | Maas et al. | 362/294 |
| 6,450,663 | B1 * | 9/2002 | Reinbach | 362/545 |
| 6,499,860 | B2 * | 12/2002 | Begemann | 362/545 |
| 6,585,395 | B2 * | 7/2003 | Luk | 362/249.02 |
| 6,793,372 | B2 * | 9/2004 | Wehner et al. | 362/247 |
| 6,827,463 | B2 * | 12/2004 | Chuang et al. | 362/92 |
| 6,953,274 | B2 * | 10/2005 | Rice | 362/526 |
| 7,204,628 | B2 * | 4/2007 | Ishida | 362/545 |
| 7,234,844 | B2 * | 6/2007 | Bolta et al. | 362/294 |
| 7,285,903 | B2 * | 10/2007 | Cull et al. | 362/227 |
| 7,300,191 | B2 * | 11/2007 | Oshio et al. | 362/545 |
| 7,311,423 | B2 * | 12/2007 | Frecska et al. | 362/372 |
| 7,325,955 | B2 * | 2/2008 | Lucas et al. | 362/545 |
| 7,427,152 | B2 * | 9/2008 | Erion et al. | 362/547 |
| 7,461,951 | B2 * | 12/2008 | Chou et al. | 362/294 |
| 7,597,453 | B2 * | 10/2009 | Simon | 362/237 |
| 7,621,664 | B2 * | 11/2009 | Nicolai | 362/294 |
| 7,766,508 | B2 * | 8/2010 | Villard et al. | 362/249.02 |
| 2006/0082271 | A1 | 4/2006 | Lee et al. | |
| 2006/0215416 | A1 | 9/2006 | Lucas et al. | |
| 2008/0041533 | A1 * | 2/2008 | Ziegler | 160/10 |
| 2008/0165528 | A1 * | 7/2008 | Lu et al. | 362/147 |

FOREIGN PATENT DOCUMENTS

| | | |
|---|---|---|
| CN | 1760734 | 4/2006 |
| DE | 203 12 760 | 10/2003 |
| DE | 103 10 742 | 9/2004 |
| JP | 2004-259824 | 9/2004 |
| JP | 2005-108544 | 4/2005 |
| JP | 2005-276778 | 10/2005 |

* cited by examiner

OTHER PUBLICATIONS

International Search Report Application No. PCT/CN2007/071363 dated Apr. 10, 2008.

*Primary Examiner* — Alan Cariaso
(74) *Attorney, Agent, or Firm* — Buchanan Ingersoll & Rooney PC

(57) ABSTRACT

A assembly includes at least a first and a second light emitting source for emission of light, and an air passage between the first and second light emitting sources to allow air flow therethrough for dissipation of heats generated by the light emitting sources.

18 Claims, 5 Drawing Sheets

LIGHT EMITTING ASSEMBLY WITH HEAT DISSIPATION STRUCTURE

FIELD OF THE INVENTION

The present invention relates generally to light emitting assembles. More particularly, the present invention relates to light emitting assemblies having heat dissipation structures.

BACKGROUND OF THE INVENTION

A light emitting assembly generally has a large planar substrate or plate with a plurality of light emitting sources which are mounted on the plate and which generate heat when emitting light. It is often desirable to remove generated heat so as to lower the temperature of the light emitting sources and the plate for reasons such as maintaining the light emitting sources within their optimal thermal operating conditions.

FIG. 1 illustrates such a type of conventional light emitting assembly having a vertical plate 100 with a plurality of light emitting sources 101 thereon. Heat generated by the light emitting sources 101 is dissipated by air flowing from the bottom of plate 100 through the middle and towards the top of the plate as indicated by arrow 103. As the air flows upwards, it is gradually heated by the light emitting sources 101 and/or the plate 100 such that the air has a higher temperature when it reaches the top of the plate 100 than at the bottom. This will adversely affect the efficiency of heat dissipation at the top, and may not be desirable in many circumstances.

Furthermore, due to the relatively ineffective heat dissipation at the top of the plate, the top may have a higher temperature than the bottom. For certain types of light emitting sources, for example, light emitting diodes, a higher temperature may result in a lower light emission. As such, the light emitting assembly 100 may have uneven light emission distribution along its height, which is often not desirable.

Heat sinks or heat pipes are generally used in conventional light emitting assemblies for enhancement of heat dissipation. However, such an extra mechanism may make the light emitting assembly unnecessarily bulky and heavy and may increase the production costs.

It is an object of the present invention to provide a light emitting assembly, which overcomes at least some of the deficiencies exhibited by those of the prior art.

SUMMARY OF THE INVENTION

According to a first aspect of the present invention, there is provided a light emitting assembly. The assembly includes at least a first and a second light emitting source for emission of light, and an air passage between the first and second light emitting sources to allow air flow therethrough for dissipation of heats generated by the light emitting sources.

Preferably, the assembly includes at least a first and a second plate, wherein each plate has an upper surface for supporting the respective first or second light source and an opposed lower surface, and wherein the first air passage is formed between one of the upper and lower surfaces of the first plate and one of those of the second plate.

Preferably, the first air passage is formed between the lower surface of the first plate and the upper surface of the second plate.

Preferably, the air passage is configured such that the air passes the second light emitting source before it passes the first substrate.

Preferably, the pair of plates are substantially parallel to each other.

Preferably, the assembly has a primary light emission direction, and wherein at least one of the first and second plates extends at an angle less than 90 degrees to the primary light emission direction such that the first air passage is formed between the first and second plates.

Preferably, the assembly further includes a substantially elongate arm to which each of the first and second plates is mounted at an end, wherein at least one of the first and second plates extends at an angle greater than 0 degree to the arm such that the first air passage can be formed between the first and second plates.

Preferably, at least one of the first and second plates is pivotably mounted to the arm such that the angle between said one of the first and second plates and the arm is adjustable.

Preferably, said angle is in a range of 3 to 85 degrees, more preferably in a range of 4 to 60 degrees, and further preferably in a range of 5 to 30 degrees.

Preferably, the assembly further includes a third plate having an upper surface for supporting a third light emitting source and an opposed lower surface, wherein the first, second and third plates are aligned substantially along an elongate direction, and wherein at least one of the first and second plates extends at an angle more than 0 degree to the elongate direction such that the first air passage can be formed between the first and second plates.

Preferably, the assembly further includes another air passage between the second and third plates to allow air flow therethrough for dissipation of heats generated by the light emitting sources.

Preferably, said angle is in a range of 3 to 85 degrees, more preferably in a range of 4 to 60 degrees, and further preferably in a range of 5 to 30 degrees.

Preferably, the assembly has a primary light emission direction, and wherein the first and second plates are positioned such that each plate is substantially away from the filed of light emission emitted by the light source on the other plate.

Preferably, the plates are formed from thermal conductive material.

Preferably, the first and second light sources emit light in a first primary light emission direction, the assembly further comprising

- a third and a fourth light emitting source for emission of light in a second primary light emission direction; and
- a second air passage between the third and fourth light emitting sources to allow air flow therethrough for dissipation of heats generated by the light emitting sources.

Preferably, the first and second primary light emission directions are substantially opposed to each other.

Preferably, the assembly further includes a center air passage in fluid connection with the first and second air passages to allow air flow therethrough.

In another aspect, the present invention provides a light emission assembly comprising:

- at two adjacent substrates each carrying at least one light source thereon, said substrates each being inclined to a common axis and displaced apart so as to form a ventilation passage therebetween so as to allow the flow of air therethrough so as to provide heat dissipation from the light sources.

The light sources are preferably located on surfaces of the substrates in a manner so as to define a common light emission direction.

Preferably the substrates are substantially parallel to each other and adapted to be inclined to a direction of incident air flow. More preferably the substrates are substantially aligned to each other along said common axis.

The light assembly preferably further comprises a plurality of substrates. Each substrates is preferably substantially equally spaced from an adjacent substrate in the direction of said common axis. Preferably each substrate carries a plurality of light sources. The substrates are preferably formed from a thermally conductive material.

Preferably the substrates are adapted to be inclined to said common axis at an inclination in the range of from 3 to 85 degrees, more preferably in the range of from 4 to 60 degrees and still more preferably in the range of from 5 to 30 degrees.

Other aspects and advantages of the invention will become apparent from the following detailed description, taken in conjunction with the accompanying drawings, which description illustrates by way of example the principles of the invention.

BRIEF DESCRIPTION OF THE DRAWINGS

The invention now will be described, by way of example only, and with reference to the accompanying drawings in which.

DETAILED DESCRIPTION

Figure 1:
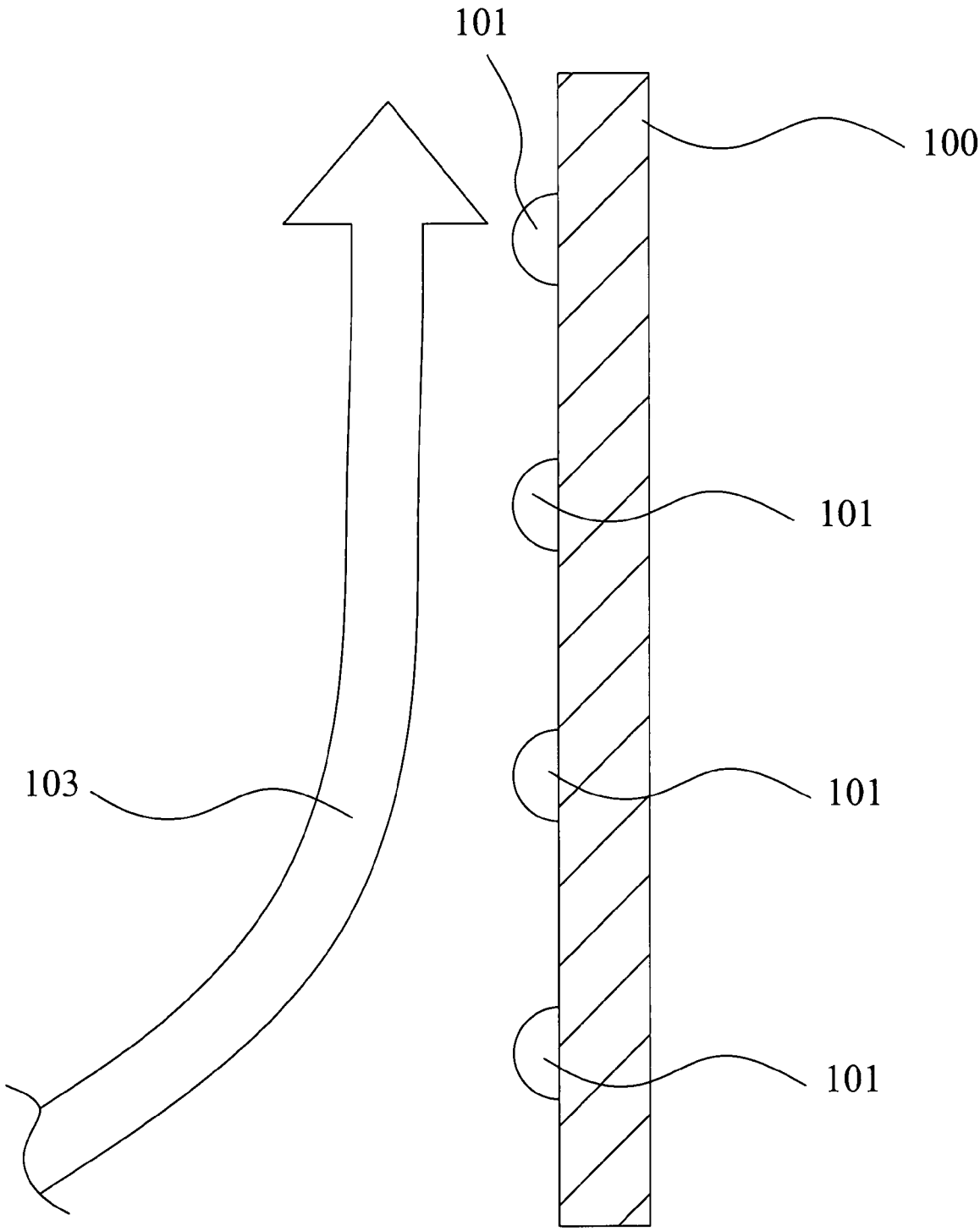
Figure 1 (Prior Art)
FIG. 1 shows a cross-sectional view of a light emitting assembly of the prior art.

The following description refers to exemplary embodiments of a light emitting assembly of the present invention. Reference is made in the description to the accompanying drawings whereby the light emitting assembly is illustrated in the exemplary embodiments. Similar components between the drawings are identified by the same reference numerals.

Figure 2A:
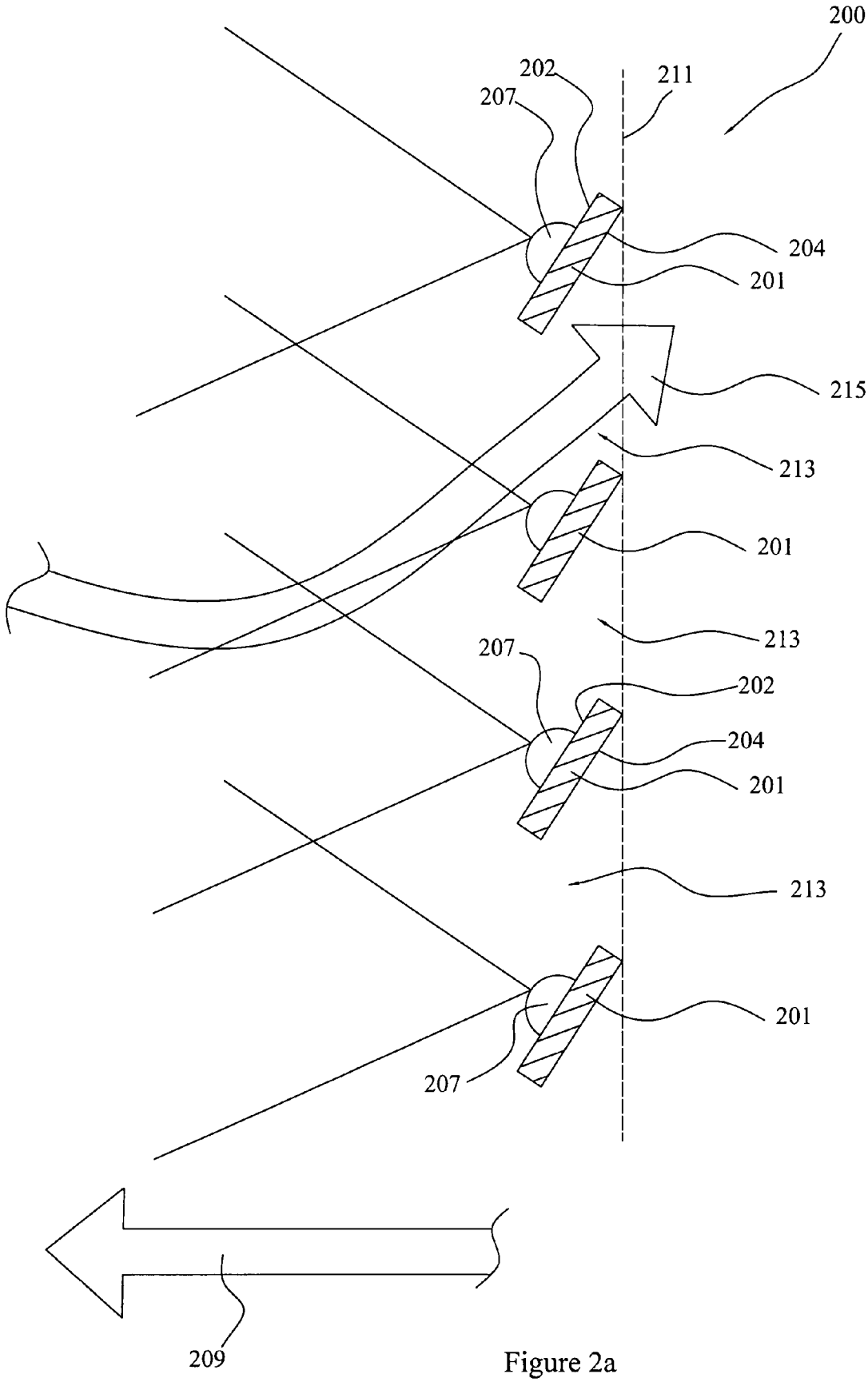
FIG. 2*a* shows a cross-sectional view of a first embodiment of the light emitting assembly according to the present invention.
Figure 2B:
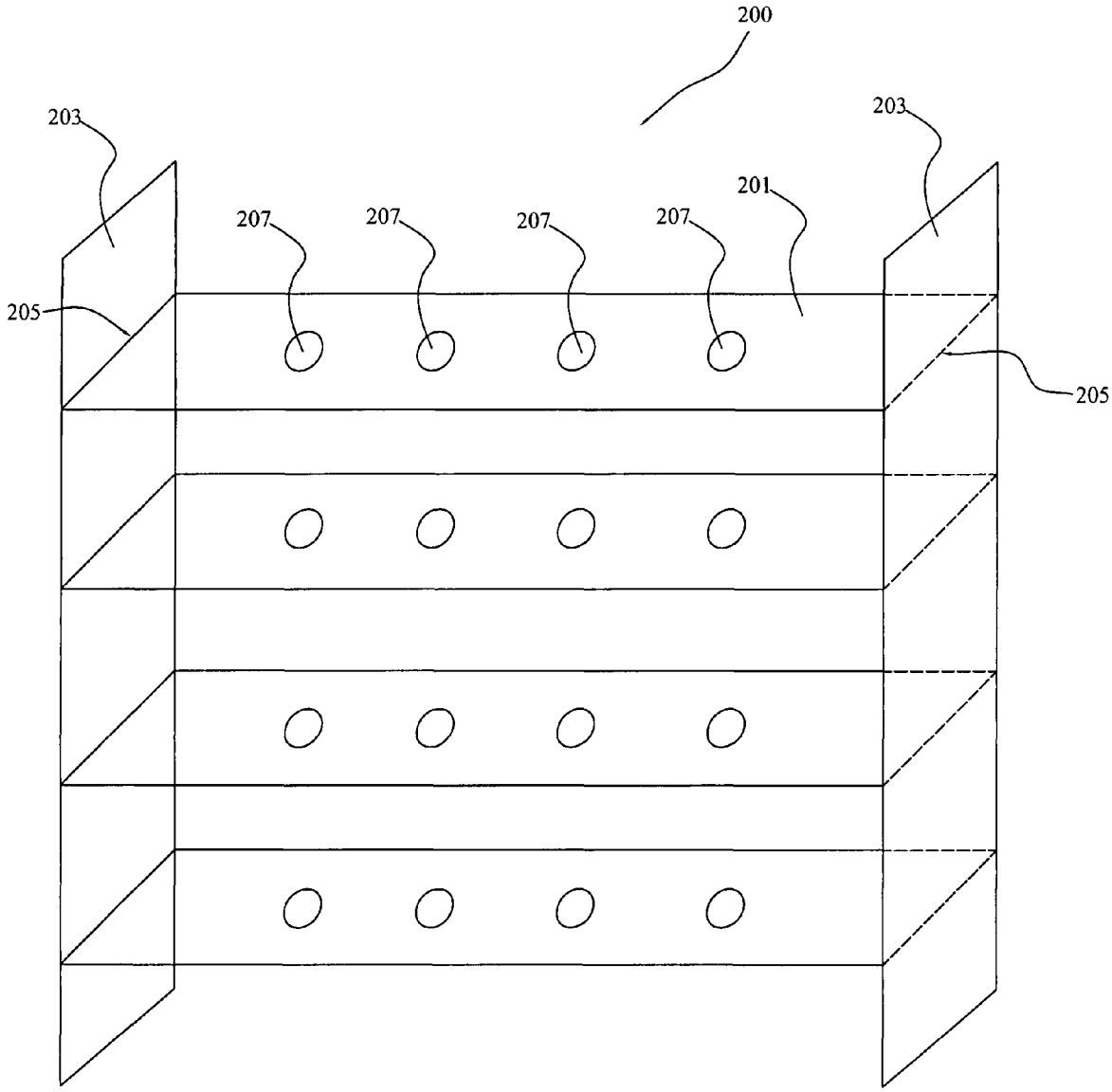
FIG. 2*b* shows a perspective view of the light emitting assembly of FIG. 1*a;*

Referring to FIGS. 2*a* and 2*b*, an exemplary embodiment of a light emitting assembly 200 of the present invention is shown, including a plurality of substantially elongate plates 201 mounted to a pair of substantially elongate arms 203 at its two longitudinal ends 205. Each plate 201 has an upper surface 202 and an opposed lower surface 204, with a plurality of light emitting sources 207, for example, light emitting diodes, lamps, or the like, provided on its upper surface 202 for emission of light in a primary light emission direction indicated by arrow 209. Furthermore, an air passage 213 is formed between each pair of adjacent plates 201, in particular, between a lower surface of one of the pair of adjacent plates and an opposed upper surface of the other plate, to allow air flow therethrough, as indicated by arrow 215, for dissipation of heats generated by the light emitting sources 201.

A skilled person in the art will appreciate that by providing an air passage between a pair of adjacent plates, air flow therethrough will remove the heat from such adjacent plates and/or the light emitting sources thereon. Thereby, the heat removed from the assembly as a whole can be increased such that the efficiency of heat dissipation can be improved.

In addition, each air flow now has a relatively short path through each plate 201. As such, the air temperature will suffer a relatively small amount of change as the air flows through the air passage such that the heat dissipation for each plate across its width is relatively uniform. Further, air flow in the different air passages 213 is substantially independent of each other and can be substantially uniformed if the various plates 201 are constructed suitably as will be appreciated by those skilled in the art. In this way, relatively even heat dissipation can be achieved amongst the various plates 201 so as to maintain a relatively uniform temperature among the various plates 201 and thus a lower heat gradient between the plates.

In the exemplary embodiment, the plates 201 are aligned substantially along a longitudinal axis 211 which is defined by the arms 203 which are substantially parallel to each other. Each plate 201 extends at an angle with respect to the longitudinal axis 211 such that the air passage 213 can be formed between the respective lower and upper surfaces of adjacent plates 201. In the exemplary embodiment, the angle is about 15 degrees. In other or alternate embodiments, the angle may be in a range of 3 to 85 degrees, preferably in the range of 4 to 60 degrees, and more preferably in the range of 5 to 30 degrees.

A person skilled in the art will appreciate that the tilt arrangement of each plate with respect to the longitudinal axis 211 reduces the air flow resistance along the air passage such that heat dissipation through natural convection can be enhanced. Furthermore, the tilt arrangement of each plate with respect to the longitudinal axis may create air pressure gradient along each air passage, which gradient will assists injecting more fresh air into the air passages to enhance the natural convection so as to cool down the light sources and/or plates and thus to improve the efficiency of heat dissipation.

To achieve a satisfactory optical output, each plate 201 has a limited width and is positioned such that a substantial amount of light emission from the light sources 207 will not be blocked by the adjacent plates. In addition, in the exemplary embodiment, the plates 201 are formed from thermally conductive materials such as metal.

Furthermore, in the exemplary embodiment of FIGS. 2*a* and 2*b*, the light emitting sources are positioned such that the air flow passes each light emitting source before it passes the corresponding adjacent plate to avoid additional pre-heating of the air by the corresponding adjacent plate, which may adversely affect the efficiency of heat dissipation.

Alternatives can be made to the above-described embodiment. For example, the light sources can be mounted on the lower surfaces 204 though the efficiency of heat dissipation can be lower than the one with the light sources on the upper surfaces as illustrated in FIGS. 2*a* and 2*b*. In addition, each plate 201 can be pivotably mounted to the arms 203 such that each tilt angle can be adjusted independently or collectively.

Figure 3:
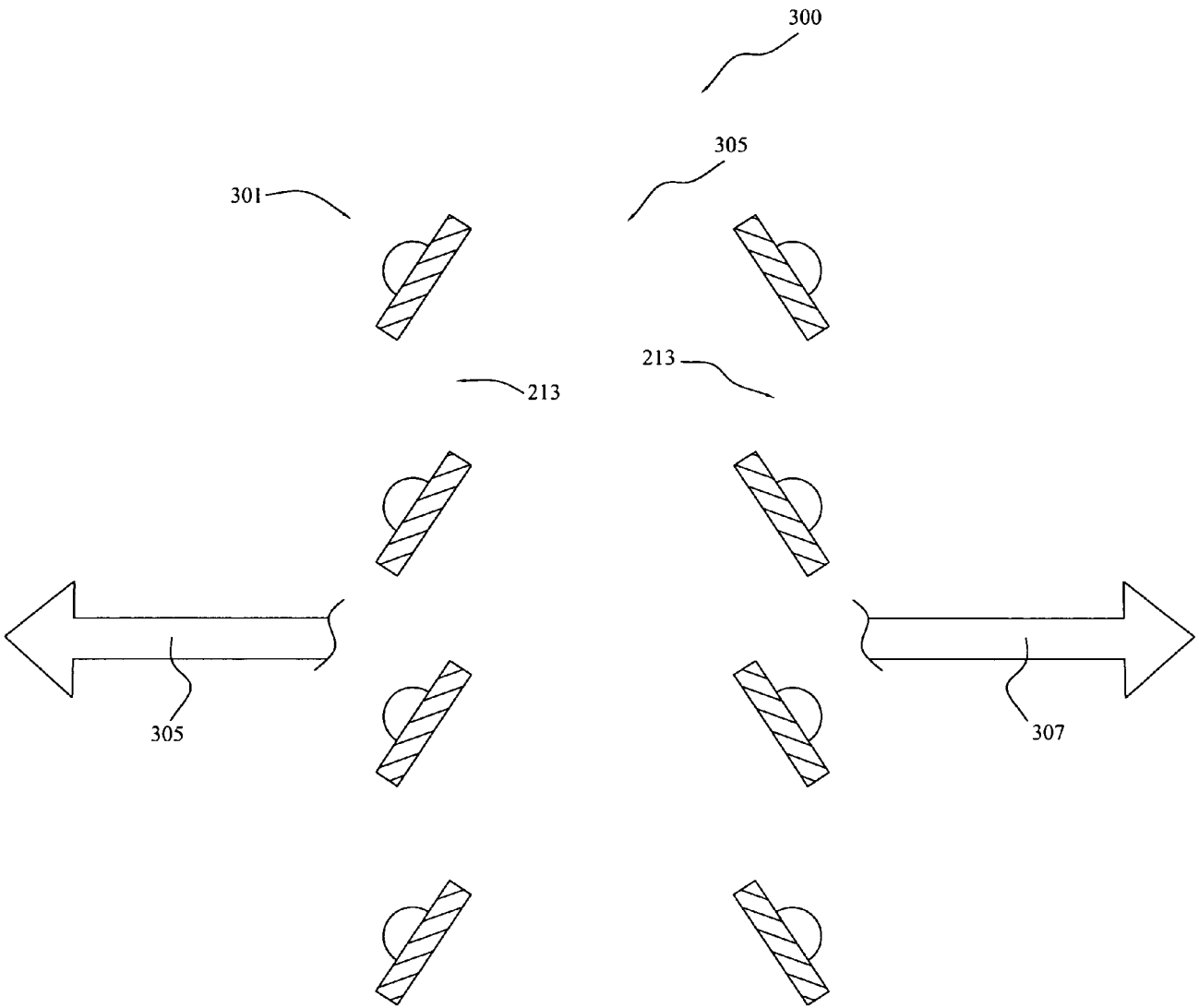
FIG. 3 illustrates a cross-sectional view of a second embodiment of the light emitting assembly of the present invention.

FIG. 3 illustrates a second embodiment of a light emitting assembly 300 of the present invention, having two light emitting assemblies 301, 303, each being identical to the one illustrated in FIGS. 2*a* and 2*b* but emitting light in opposed directions as indicated by arrows 305, 307. Furthermore, the two light emitting assemblies 301, 303 are spaced apart to form a center air passage 305 which joins the air passages 213 of the two light emitting assemblies 301, 303 for allowing air to flow therethough.

Figure 4:
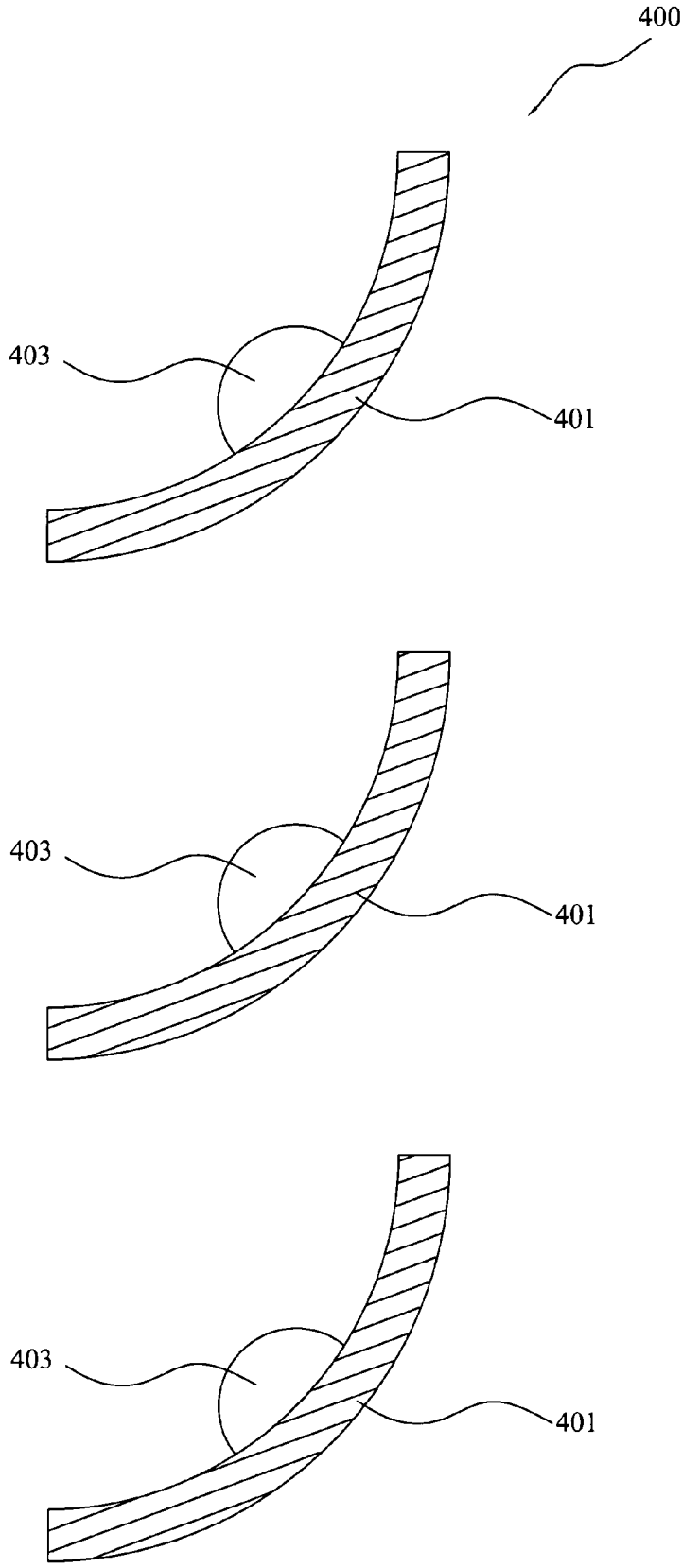
FIG. 4 illustrates a cross-sectional view of a third embodiment of the light emitting assembly of the present invention.

FIG. 4 illustrates a third embodiment of a light emitting assembly 400 of the present invention, similar to the one of FIGS. 2*a* and 2*b*, but with each plate 401 in a curved shape.

Each plate 401 can be formed from a reflective material and configured for appropriate reflection of light from the light emitting sources 403 as could be appreciated in the art.

It will be understood that the invention disclosed and defined herein extends to all alternative combinations of two or more of the individual features mentioned or evident from the text or drawings. All of these different combinations constitute various alternative aspects of the invention. The foregoing describes an embodiment of the present invention and modifications, apparent to those skilled in the art can be made thereto, without departing from the scope of the present invention.

Although the invention is illustrated and described herein as embodied, it is nevertheless not intended to be limited to the details described, since various modifications and structural changes may be made therein without departing from the spirit of the invention and within the scope and range of equivalents of the claims.

Furthermore, it will be appreciated and understood that the words used in this specification to describe the present invention and its various embodiments are to be understood not only in the sense of their commonly defined meanings, but also to include by special definition in this specification structure, material or acts beyond the scope of the commonly defined meanings. Thus, if an element can be understood in the context of this specification as including more than one meaning, then its use in a claim must be understood as being generic to all possible meanings supported by the specification and by the word itself. The definitions of the words or elements of the following claims are, therefore, defined in this specification to include not only the combination of elements which are literally set forth, but all equivalent structure, material or acts for performing substantially the same function in substantially the same way to obtain substantially the same result, without departing from the scope of the invention.

What is claimed is:

1. A light emitting assembly comprising a first and a second plate each including opposed first and second surfaces, the first and second plates being arranged in alignment along a substantially longitudinal axis, the longitudinal axis being configured for positioning in substantial alignment with a direction of gravity in use, the second surface of the second plate being arranged so as to extend substantially across the first surface of the first plate in a substantially transverse direction relative to the longitudinal axis;

a first and a second light emitting source disposed on the first surfaces of the first and second plates respectively, said first and second light emitting sources being adapted to emit light substantially in a primary light emission direction, said primary light emission direction including a substantially perpendicular direction relative to the longitudinal axis;

at least one elongate arm for supporting the first and second plates, ends of the first and second plates being mounted to the at least one elongate arm wherein at least one of the first and second plates is arranged at an angle of less than 90 degrees relative to the longitudinal axis; and wherein the first and second plates and the elongate arm collectively define an airflow passage having an inlet and an outlet disposed on opposing ends of the airflow passage, whereby air is able to enter the airflow passage via the inlet to dissipate heat generated by the light emitting sources, pass through the airflow passage, and exit via the outlet to transfer heat away from the light emitting sources.

2. The assembly of claim 1, wherein the air passage is configured such that the air passes the second light emitting source before it passes the first plate.

3. The assembly of claim 1, wherein the pair of plates are substantially parallel to each other.

4. The assembly of claim 1, wherein at least one of the first and second plates is pivotably mounted to the arm such that the angle between said one of the first and second plates and the arm is adjustable.

5. The assembly of claim 1, wherein said angle is in a range of 3 to 85 degrees.

6. The assembly of claim 5, wherein said angle is in a range of 4 to 60 degrees.

7. The assembly of claim 6, wherein said angle is in a range of 5 to 30 degrees.

8. The assembly of claim 1, further comprising a third plate having a first surface for supporting a third light emitting source and an opposed second surface, wherein the first, second and third plates are aligned substantially along the longitudinal axis.

9. The assembly of claim 8, further comprising another air passage between the second and third plates to allow air flow therethrough for dissipation of heats generated by the light emitting sources.

10. The assembly of claim 8, wherein said angle is in a range of 3 to 85 degrees.

11. The assembly of claim 10, wherein said angle is in a range of 4 to 60 degrees.

12. The assembly of claim 11, wherein said angle is in a range of 5 to 30 degrees.

13. The assembly of claim 1, wherein the first and second plates are positioned such that each plate is substantially away from the field of light emission emitted by the light source on the other plate.

14. The assembly of claim 1, wherein the plates are formed from thermal conductive material.

15. The assembly of claim 1, wherein the first and second light sources emit light in a first primary light emission direction, the assembly further comprising a third and a fourth light emitting source for emission of light in a second primary light emission direction; and a second air passage between the third and fourth light emitting sources to allow air flow therethrough for dissipation of heats generated by the light emitting sources.

16. The assembly of claim 15, wherein the first and second primary light emission directions are substantially opposed to each other.

17. The assembly of claim 15, further comprising a center air passage in fluid connection with the first and second air passages to allow air flow therethrough.

18. A light assembly according to claim 1, wherein each of the first and second plates includes a plurality of light sources.

* * * * *